United States Patent [19]

Lawrence

[11] Patent Number: 4,860,504

[45] Date of Patent: Aug. 29, 1989

[54] STRESSED STRUCTURE SHELTER

[76] Inventor: Albert B. R. Lawrence, 23 Davidson Drive, Ottawa, Ontario, Canada

[21] Appl. No.: 181,418

[22] Filed: Apr. 14, 1988

[51] Int. Cl.[4] ..... E04B 1/32

[52] U.S. Cl. ..... 52/86; 52/222; 52/225

[58] Field of Search ..... 52/222, 225, 226, 165, 52/82, 86, 200

[56] References Cited

U.S. PATENT DOCUMENTS

| | | | |
|---|---|---|---|
| 284,219 | 9/1883 | Mehew | 52/165 X |
| 427,815 | 5/1890 | Wolf | 52/165 |
| 1,123,105 | 12/1914 | Crews | 52/165 |
| 2,237,226 | 4/1941 | High | 52/86 X |
| 2,988,810 | 6/1961 | Wilken | 52/222 X |
| 3,325,951 | 6/1967 | Johnson | 52/86 |
| 3,364,634 | 1/1968 | Allaire | 52/222 X |
| 4,083,153 | 4/1978 | Sumpter | 52/222 X |
| 4,173,587 | 11/1979 | Kosaka | 52/225 X |
| 4,193,239 | 3/1980 | Barto | 52/222 |
| 4,509,302 | 4/1985 | Donatelli | 52/82 |
| 4,543,757 | 10/1985 | Cosgrove | 52/165 X |
| 4,570,395 | 2/1986 | Zima | 52/222 X |
| 4,646,489 | 3/1987 | Feller et al. | 52/165 |

FOREIGN PATENT DOCUMENTS

| | | | |
|---|---|---|---|
| 492169 | 4/1953 | Canada | 52/222 |

*Primary Examiner*—David A. Scherbel
*Assistant Examiner*—Anthony W. Williams
*Attorney, Agent, or Firm*—Stanley E. Johnson

[57] ABSTRACT

A structure including two or more posts, an elastically bendable panel and tension members where the panel is forceably held in a curved state by the tension members acting preferably through the posts whereby the entire structure is in a predetermined state of stress.

9 Claims, 2 Drawing Sheets

STRESSED STRUCTURE SHELTER

FIELD OF INVENTION

The present invention relates generally to free standing shelters and more particularly to a shelter wherein the major components are stressed to rigidify the structure.

BACKGROUND OF THE INVENTION

Traditionally buildings have vertical elements (walls), horizontal elements (roofs), and cross bracing as may be necessary to overcome lateral forces such as wind loading and the like. Roof elements may be in the form of a beam (lintel), a triangle or a series of triangles (i.e. trusses), or a geodesic structure or conic section (i.e. an arch). The roof element can function alone when used as, so to speak "a pup tent" or "a nissen-hut" or as a bridge.

The required rigidity of buildings is assured by the weight of the components, by individual cross ties (bracing) and/or an infinite number of cross ties i.e. a plate or diaphram. These are found in various combinations and sub-combinations suited to the use or requirement of and for the building.

SUMMARY OF THE INVENTION

The present invention involves the use of leverage and the application of force to a building structure to enhance its strength and rigidity and is particularly useful in spanning large areas. While the invention herein is described with reference to a shelter it also has particular application to forms used in making poured concrete structures. Also the shelter herein described is a free standing structure but obviously may be attached to other structures which may be either the same or of different construction.

The simplest form for a structure of present invention includes a roof bent to form an arch and due to its spring effect thrusts outwardly against and applies pressure on posts which are anchored. The posts may be vertical, slope upwardly and outwardly from one another or slope upwardly and inwardly toward one another. The outward thrust of the arch is counter-acted by a horizontal tie line or tension element in the form of a cable, rod, or the like anchored to the roof element by direct attachment, to a bracket that engages the roof panel or to the posts which have the brackets attached thereto or various combinations thereof. The result is that the posts and roof are in a predetermined state of stress.

LIST OF DRAWINGS

The invention is illustrated by way of example in the accompanying drawings wherein.

DESCRIPTION OF PREFERRED EMBODIMENT

Figure 1:
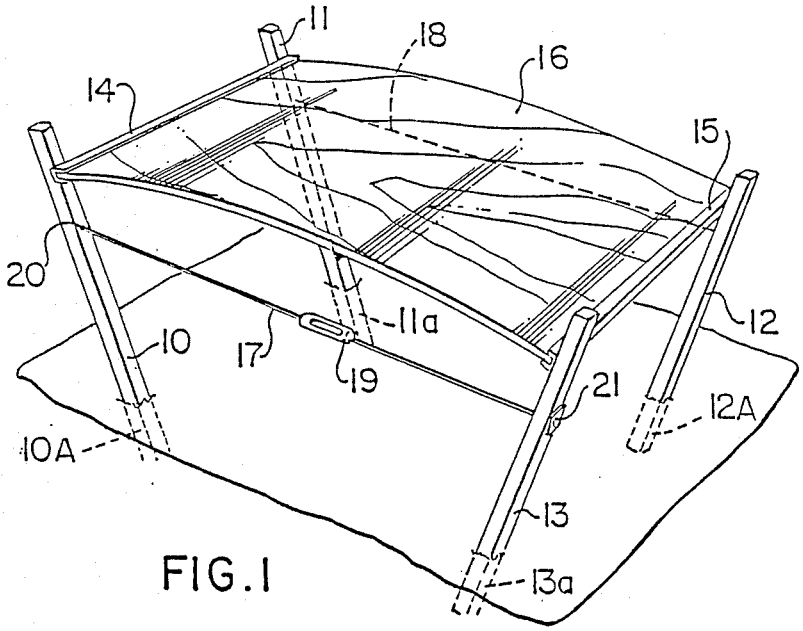
FIG. 1 is an oblique view of a shelter provided by a structure system of the present invention.

A carport or other shelter, constructed in accordance with the present invention, is illustrated in FIG. 1 and consists essentially of four sloped posts, and an arched panel roof supported by the posts and forceably retained in such shape by one or more tension members. The free standing structure illustrated comprises four upwardly and outwardly sloped posts 10, 11, 12 and 13, each of which has a portion (designated respectively at 10A, 11A, 12A and 13A) projecting into the ground. The posts may be set in concrete if desired, or attached to a metal channel or the like forced into the ground, or simply project into the ground itself. Alternatively the lower end of the posts can merely rest on the ground (or other foundation) and have the posts at one end of the structure connected by a compression member or members to the posts at the opposite end of the structure.

In the embodiment illustrated in FIG. 1 the pair of posts 10 and 11 are interconnected adjacent their upper ends by a horizontally disposed channel 14. Similarly a horizontally disposed channel 15 interconnects posts 12 and 13 at the other end of the structure. The channels 14 and 15 face one another and receive respective opposite ends of a panel 16 that constitutes a roof of the shelter.

The roof is a stressed diaphram or panel 16 which may be plywood, chipboard, of plastics material or glass fibre reinforced panels or combinations thereof and is stressed into the bowed or curved state and forceably held in such bowed condition. The elastic or spring effect or springiness of the panel causes the panel to try to straighten out to its original flat condition and this is resisted by tension or cable members 17 and 18 that span from one post to the other at opposite ends of the structure. The channels 14 and 15 distribute the load evenly to the ends of the panel 16 so as to prevent crushing that otherwise would occur from having a concentrated load at any one point.

The tension members 17 and 18 are twisted metal cables, solid rods or the like, which preferably are selectively variable in length permitting adjusting the tension by way of, for example, turnbuckles 19. The cable 17 is attached at its respective opposite ends to posts 10 and 13 while the other cable 18 is attached at its respective opposite ends to posts 11 and 12. The attachment of the cables to the posts is below the respective channels 14 and 15, and this downward spacing from the channels constitutes a lever arm for and in the stressing of the roof panel. The roof panels resistance to bending is counteracted by a reaction force at the lower end of the post by the ground or by a compression member interconnecting the posts as the case may be.

From the foregoing, it will be seen all of the components have forces imposed thereon in addition to the conventional gravitational or weight forces of the components themselves. The point of application, the manner of application, the degree of force and the like are so chosen as to provide maximum strength for the components utilized minimizing the quantity and bulkiness of the components in providing a shelter of appropriate size and strength.

In the embodiment illustrated, cables 17 and 18 pass through an aperture 20 in the respective posts and have a formation 21 on the outer end thereof engageable with a plate 21A that abuts against a face of the post. Obviously various connecting means may be utilized joining the respective cables to the posts.

Figure 3:
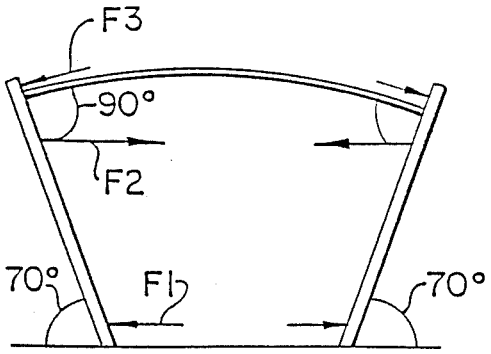
FIG. 3 is a side elevational view of the structure illustrated in FIG. 1.

FIG. 3 is a side elevational view of the structure illustrated in FIG. 1 wherein the forces of the various components are designated F1, F2 and F3. Force F1 represents the reactionary force on the lower end of the post by virtue of its abutment with the ground or foundation structure or compression interconnecting member as the case may be. The force F2 is tension of the cable pulling on the post and this is counteracted by force F3 which represents the force because of the panels curvature and its resistance to bending i.e. the elasticity of the panel. The posts, as previously mentioned, slope upwardly and outwardly making a preferred angle of 70° with the horizontal as indicated and the angle between the post and adjacent surface of the roof panel is preferably 90° as indicated. Obviously those skilled in the art can readily calculate the most appropriate angles for the various structures to provide maximum strength with mimimum material.

Figure 2:
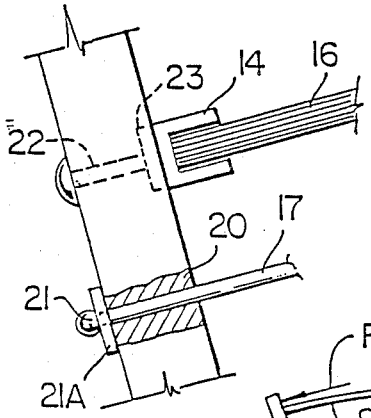
FIG. 2 is an enlarged view of a portion of FIG. 1.

The opposed ends of the roof panel 16 project into respective channels 14 and 15, and such channels are attached to the posts in any convenient manner. One means of attaching them is, for example, by way of a bolt 22 as illustrated in FIG. 2 and optionally the channel may nest into a notch designated 23.

Figure 4:
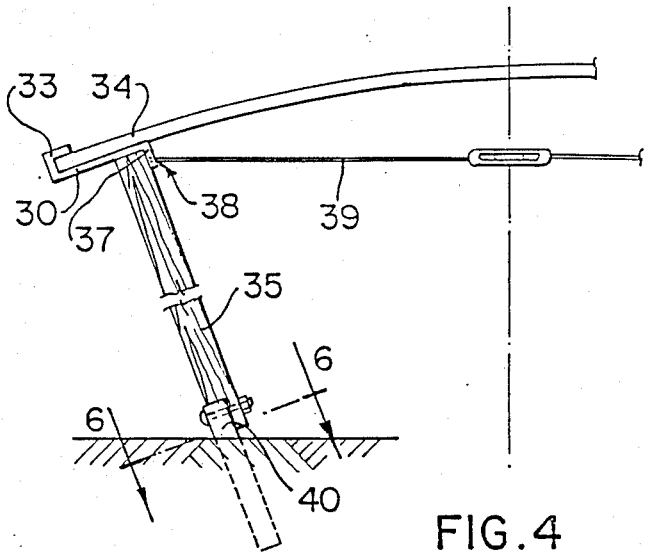
FIG. 4 is a lefthand side elevational view of a modified structure in accordance with the present invention.
Figure 6:
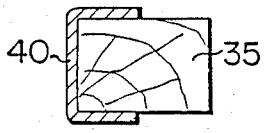
FIG. 6 is a sectional view taken along line 6—6 of FIG. 4.
Figure 5:
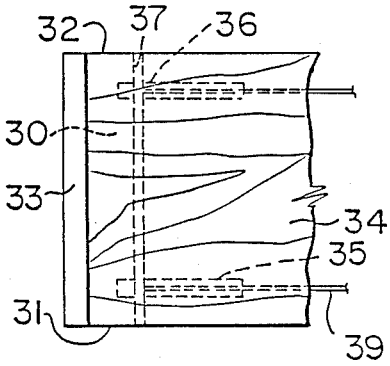
FIG. 5 is a top plan view of the portion of the structure illustrated in FIG. 4.

In the embodiment illustrated in FIG. 1, the posts are located outwardly of the roof panel, but for aesthetic and/or other reasons, it may be desirable to have the posts spaced inwardly from such end edges of the roof. Such embodiment is illustrated in FIGS. 4 and 5 wherein the channels 14 and 15 of FIG. 1 are replaced by a relatively wide plate member that rests on top of the posts and is attached to the posts by suitable means and at a suitable location. The plate may be made of metal or a plastics material or combinations thereof and has a channel for receiving the edge of the roof panel located outwardly from the posts.

Referring specifically to FIGS. 4 and 5, there is illustrated a plate 30 that extends from one edge 31 of the roof panel to the roof panels opposite edge 32. The plate 30 has a channel 33 into which the edge of the roof panel 34 projects. The plate 30 rests on top of the upwardly and outwardly sloped posts 35 and 36 and attachment thereto may be made in any convenient manner. In the embodiment illustrated, the plate 30 has a downwardly projecting ledge or flange 37 that may be bolted to their respective posts and if desired, may also have means for attaching thereto an end 38 of an adjustable length tension member 39. In FIGS. 4 and 5 only the lefthand portion of the structure is illustrated and obviously the righthand portion is a mirror image thereof containing an identical or similar plate.

In the embodiment illustrated in FIGS. 4 and 5 each post instead of projecting into the ground is bolted to a U-shaped channel member 40 that has been driven into the ground at a slope corresponding to the slope of the post.

Figure 7:
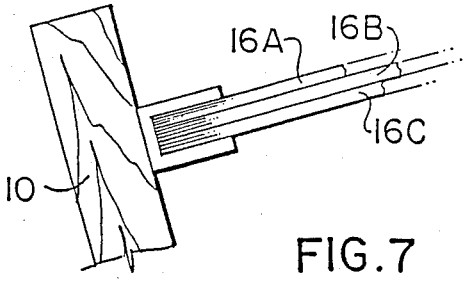
FIG. 7 is a view similar to FIG. 2, but illustrating a minor modification.

FIG. 7 illustrates a minor variant to the embodiment of FIGS. 1 and 2 with respect to the roof paneling. In FIG. 7, the roof comprises a plurality of panels designated 16A, 16B and 16C overlying one another and which in the initial stages of construction are slidable relative to one another. After the roof has been suitably bowed to its final position, the multilayers may then be joined together structurally to act in unison i.e. as a single sheet or panel.

In the foregoing, the posts are described and illustrated in the drawings as sloping upwardly and outwardly which is the preferred embodiment. The posts, however, may be vertical, sloped in the opposite direction i.e. upwardly and inwardly or be sloped in the direction illustrated, but at a substantially greater slope.

In the foregoing, the structure as defined is a free standing shelter, but it will be quite obvious it need not be free standing and furthermore the system may advantageously be used as forms for pouring concrete structures. Such use is particularly advantageous because of the ability to adjust the tension in members 17 and 18 thereby permitting the creation of an exact prescribed geometric shape and/or dimension for the roof element. There are numerous other uses which will become obvious to those skilled in the art.

Applicant should like to point out FIG. 1 illustrates the shelter or structure in its final state. Obviously setting of the posts tightly in the ground can take place only after the posts have been drawn together forcing the roof panel to its desired curvature as this requires the posts to move somewhat.

I claim:

1. A shelter comprising:

(A) at least four spaced apart posts supported at their lower end and having an opposite upper end at a higher elevation;

(B) a roof covering the area of the shelter and comprising an elastic bendable rectangular panel having a pair of respective opposite ends, two of said posts being located at one of said opposite ends of said panel and another two of said posts being located at the other of said opposite ends of said panel;

(C) means connecting said roof panel to said posts adjacent their upper ends for support thereby, said roof panel being stressed into a curved form bowing upwardly between said opposed opposite ends thereof, said means connecting said roof panel to said posts comprising a pair of elongate channel members located one at each of said respective opposite ends of said panel, said channels extending from one post to the other at said respective opposite ends of said roof panel and having an end portion of the roof panel projecting thereinto; and (D) tension members anchored at their opposite ends to said posts at opposite ends of said roof panel and tensioned forcibly retaining said roof panel in said curved form.

2. A shelter as defined in claim 1 wherein said tension members comprise cables, rods or the like extending from a post at one end of the structure to a post at the other end of the structure and including cable tension adjusting means.

3. A shelter as defined in claim 1 wherein said connecting means comprises at respective opposite ends of the shelter a plate supported on the upper ends of the posts and having a channel extending longitudinally therealong on the upper surface thereof receiving an end edge of the panel at a position outboard of the posts, said plate extending from one post to another at one end of the structure and abutting the posts associated therewith inboard of the structure.

4. A shelter as defined in claim 1 including compression members interposed between and connected to posts respectively at opposite ends of the shelter.

5. A shelter as defined in claim 1 wherein said posts at opposite ends of the shelter slope upwardly and outwardly away from one another.

6. A shelter as defined in claim 2 wherein the tension members are attached to the posts at a position spaced downwardly a selected distance from the point of connection of the roof panel to such posts.

7. A shelter comprising four posts spaced apart from one another in rectangular fashion and anchored at their lower end to support means, two of said posts being located adjacent one end of the shelter and the other two posts at an opposite end, a pair of elongate channel members facing one another and located on the inboard side of said posts, one of said channel members being attached to the said two posts at one end of the structure and the other of said channel members being attached to two of said posts at the other end of the structure, tension members attached at respective opposite ends to posts at opposite ends of the shelter and at a position spaced downwardly a selected distance from the channel member associated with such posts and a composite rectangular roof panel having opposite ends projecting into respective ones of said pair of channel members, said tension members being tensioned forceably retaining said roof panel in a curved upwardly bowed form.

8. A shelter as defined in claim 7 wherein said panel is made of wood pieces bonded together.

9. A shelter as defined in claim 8 wherein said panel is plywood.

* * * * *